US006597344B1

(12) United States Patent
Narusawa et al.

(10) Patent No.: US 6,597,344 B1
(45) Date of Patent: Jul. 22, 2003

(54) KEY SWITCH DISPOSED ON KEYBOARD INPUT DEVICE AND METHOD OF PRODUCING THE SAME

(75) Inventors: Tsuyoshi Narusawa, Fukushima-ken (JP); Masaaki Kageyama, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 176 days.

(21) Appl. No.: 09/696,403

(22) Filed: Oct. 24, 2000

(30) Foreign Application Priority Data

Nov. 11, 1999 (JP) ..... 11-321238

(51) Int. Cl.[7] ..... G09G 5/00; H01H 13/70

(52) U.S. Cl. ..... 345/168; 200/5 A; 200/344; 200/345

(58) Field of Search ..... 345/156, 160, 345/168, 169; 200/5 A, 341, 344, 517; 361/680; 400/496

(56) References Cited

U.S. PATENT DOCUMENTS 4,433,225 A * 2/1984 Cowles ..... 200/344
5,463,195 A 10/1995 Watanabe et al. ..... 200/5 A
5,504,283 A * 4/1996 Kako et al. ..... 200/344
5,630,501 A * 5/1997 Tsay ..... 200/341
5,746,308 A * 5/1998 Lin ..... 200/344
5,747,758 A * 5/1998 Hochgesang et al. ..... 200/344
5,767,464 A * 6/1998 Dyer et al. ..... 200/344
5,767,468 A * 6/1998 Tsai ..... 200/344
5,819,914 A * 10/1998 Yoneyama ..... 200/341
5,967,298 A 10/1999 Watanabe et al. ..... 200/344
6,072,133 A * 6/2000 Takagi et al. ..... 200/341

* cited by examiner

*Primary Examiner*—Amare Mengistu
*Assistant Examiner*—Jeff Piziali
(74) *Attorney, Agent, or Firm*—Beyer Weaver & Thoma LLP

(57) ABSTRACT

A key switch in which a pair of lever members which form a cross-link member are molded out of resin materials having different shrinkage coefficients. A shaft-receiving hole is formed in the lever member molded out of the resin material having a small shrinkage coefficient, while a linking shaft is formed on the lever member molded out of the resin material having a large shrinkage coefficient. When the key switch is structured in this way, after the lever member having the shaft-receiving hole has been molded, the resin material having a large shrinkage coefficient is hardened in a die in which the shaft-receiving hole forms a portion of a cavity in order to form the other lever member. By forming the other lever member, the linking shaft is formed in a pivotally mounted state in the shaft-receiving hole. Therefore, it is no longer necessary to link the pair of lever members by a manual operation. Accordingly, the invention provides a key switch which makes it possible to easily and reliably link a pair of lever members which support a key top in order to form a cross-link member without having to carry out a manual operation, and which makes it possible to accelerate size reduction and to carry out an assembly operation with greater ease. The invention also provides a method of producing the same.

8 Claims, 11 Drawing Sheets

KEY SWITCH DISPOSED ON KEYBOARD INPUT DEVICE AND METHOD OF PRODUCING THE SAME

CROSS REFERENCE TO RELATED APPLICATION

This application is related to U.S. patent application Ser. No. 09/696,712 filed on the same date herewith and entitled "KEY SWITCH WITH EASILY ATTACHABLE KEY TOP, " the content of which is hereby incorporated by reference.

BACKGROUND OF THE INVENTION

1. Field of the Invention

The present invention relates to a key switch disposed on a keyboard input device, and a method of producing the same.

2. Description of the Related Art

In recent years, various types of key switches suitable for reducing the thickness of a keyboard input device have been proposed. The various types of key switches are constructed so that a key top is supported at the top ends of a pair of lever members linked together in such a way as to cross each other, and the crossing angle of the pair of lever members changes with the raising and lowering of the key top.

For example, there is disclosed a key switch having a structure which uses a cross-link member for guiding the raising and lowering operation of a key top. In the cross link member, lever members are linked together at intersection portions thereof. The top end of one of the lever members rotatably engages the bottom surface of the key top, whereas the top end of the other lever member slidably engages the bottom surface of the key top.

In this type of key switch, when an operator depresses a key top, the pair of lever members are lowered, causing the cross-link member to be pushed downward. When the key top has descended by a predetermined amount, a resilient member, such as a click rubber, is pushed by the key top and gets buckled, so that a switch element, such as a membrane switch, is pushed by the resilient member, causing the switch to be turned on. When the pressing force on the key top of the switch in an ON state is removed, the buckled resilient member returns to its original shape as a result of its resiliency. Therefore, the switch element is restored to the OFF state, and the key top is pushed upward to its initial position as the lowered pair of lever members are raised.

Compared to a commonly used structure in which a key stem is slid along a guide wall, such a structure in which a key top is supported by a cross-link member so that it can be raised and lowered makes it possible to ensure ease of operation and to considerably reduce the height of the key switch.

In the conventional key switch that includes a cross-link member in which a pair of lever members are linked so that they intersect each other, the cross-link member is formed as a result of linking both lever members at their intersection portions after they have been molded. Here, it is necessary to carry out an assembly operation in which a linking shaft provided on one of the lever members is inserted into a shaft-receiving hole formed in the other lever member in order to pivotally mount it thereto. However, in recent years, key switches are becoming smaller in size, so that lever members of cross-link members are becoming considerably smaller in size, making the assembly operation troublesome to carry out because small molded lever members need to be manually linked together in order to form a cross-link member. In particular, when the production of smaller key switches is accelerated, it inevitably becomes extremely difficult to link a pair of lever members by a manual operation.

SUMMARY OF THE INVENTION

In view of the above-described conventional problems, it is an object of the present invention to provide a key switch which makes it possible to easily and reliably link a pair of lever members which support a key top in order to form a cross-link member without having to link them by a manual operation, and which makes it possible to accelerate size reduction and to perform an assembly operation with greater ease. It is also an object of the present invention to provide a method of producing the same.

To these ends, according to one aspect of the present invention, there is provided a key switch comprising a pair of lever members which are rotatably linked together at crossing portions thereof by pivotally mounting a linking shaft in a shaft-receiving hole, a key top which supports the pair of lever members so as to raise and lower the lever members, a resilient member for biasing the key top upwards, and a switch element for performing a switching operation with the raising and lowering of the key top. In the key switch, the pair of lever members are molded out of resin materials having different shrinkage coefficients. The shaft-receiving hole is formed in the lever member formed of the resin material having a small shrinkage coefficient. The linking shaft is formed at the lever member formed of the resin material having a large shrinkage coefficient.

In the key switch having this structure, a conventionally known two-color molding technology is used to successively mold the pair of lever members in order to form the cross-link member. Therefore, it is no longer necessary to manually link the pair of lever members. Consequently, even if the lever members are small due to the size reduction of the key switch, a troublesome assembly operation does not need to be carried out.

More specifically, in a method of producing such a key switch in accordance with the present invention, the lever member which has the shaft-receiving hole formed therein is molded as a result of hardening a first resin material in a die. Then, a second resin material having a shrinkage coefficient which is greater than that of the first resin material is hardened in a die in which the shaft-receiving hole forms a portion of a cavity in order to mold the other lever member. By molding the other lever member, the linking shaft is formed in a pivotally mounted state in the shaft-receiving hole.

Accordingly, when the lever member which is formed of a resin material having a small shrinkage coefficient and which has the shaft-receiving hole is molded, and then a resin material having a large shrinkage coefficient is used for molding where the shaft-receiving hole forms a portion of a cavity, the linking shaft is formed in a pivotally mounted state in the shaft-receiving hole at the stage of cooling and hardening of the resin material. Therefore, the pair of lever members can be easily and reliably linked together without carrying out a manual operation in order to form the cross-link member.

DESCRIPTION OF THE PREFERRED EMBODIMENT

Hereunder, a description of an embodiment of the present invention will be given with reference to the drawings.

Figure 1:
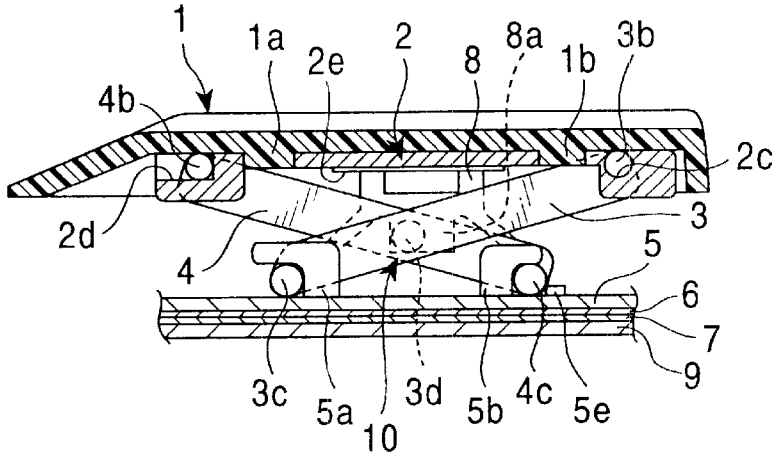
FIG. 1 is a sectional view of an embodiment of a key switch in accordance with the present invention.
Figure 2:
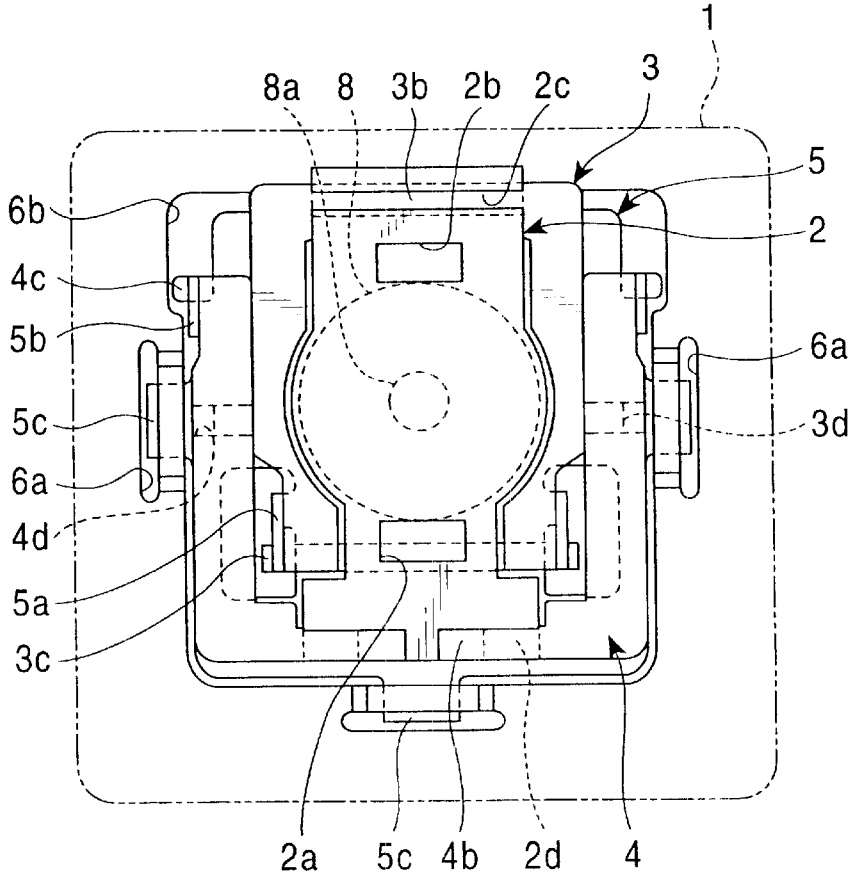
FIG. 2 is a plan view of the key switch.
Figure 3:
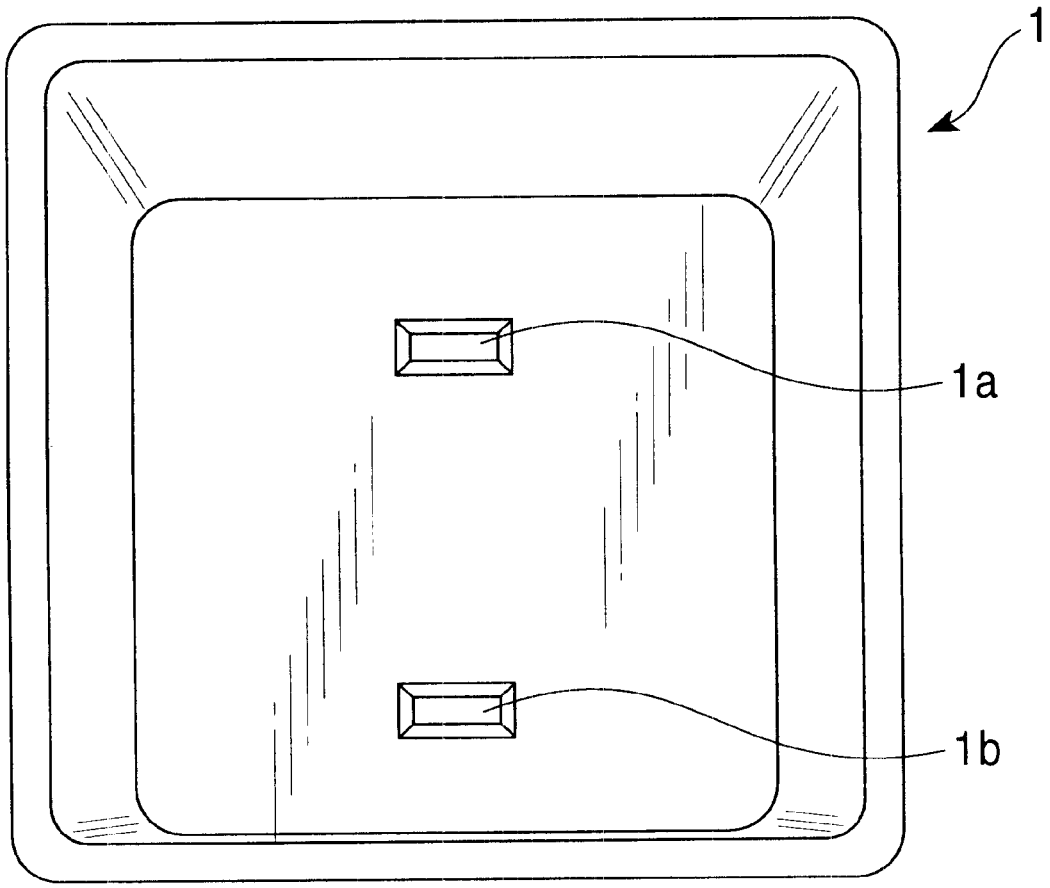
FIG. 3 illustrates the bottom surface of a key top of the key switch.
Figure 4:
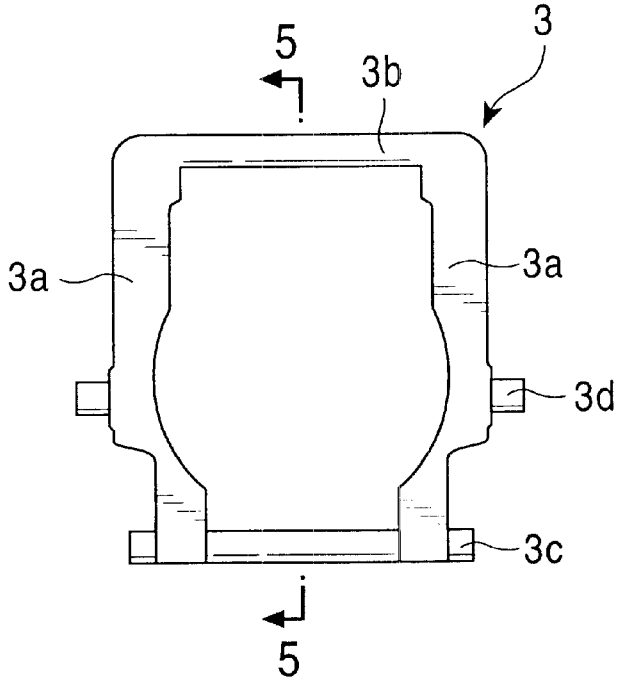
FIG. 4 is a plan view of an inner lever member of the key switch.
Figure 5:
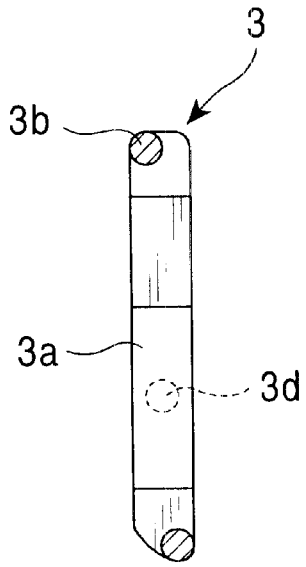
FIG. 5 is a sectional view taken along line 5—5 of FIG. 4.
Figure 6:
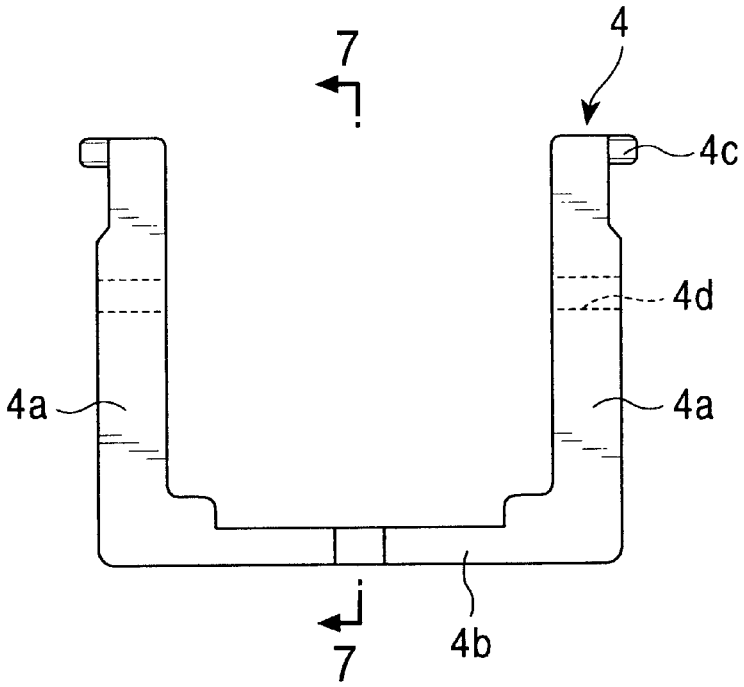
FIG. 6 is a plan view of an outer lever member of the key switch.
Figure 7:
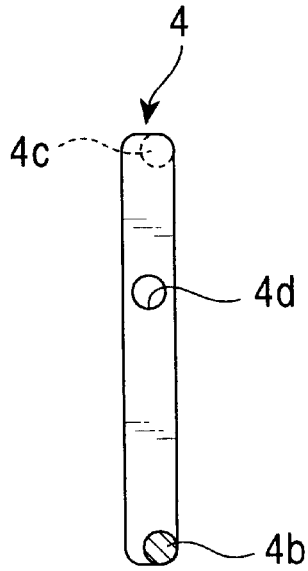
FIG. 7 is a sectional view taken along line 7—7 of FIG. 6.
Figure 8:
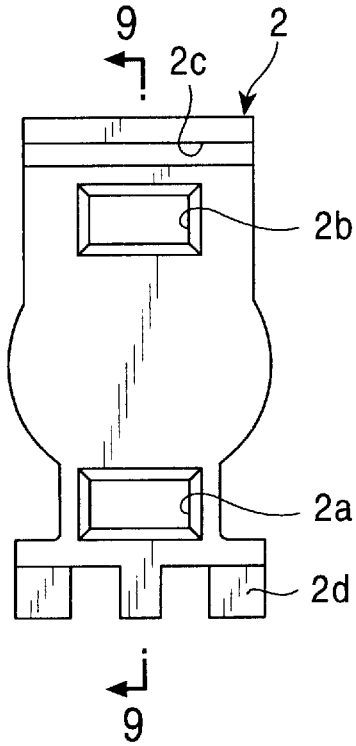
FIG. 8 is a plan view of an actuator of the key switch.
Figure 9:
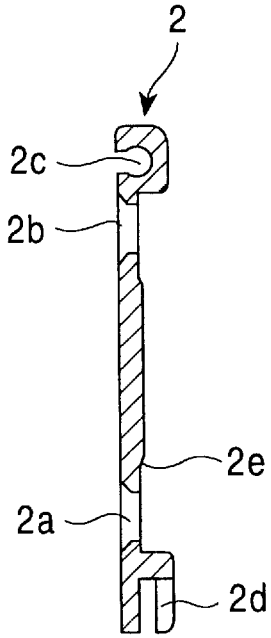
FIG. 9 is a sectional view taken along line 9—9 of FIG. 8.
Figure 10:
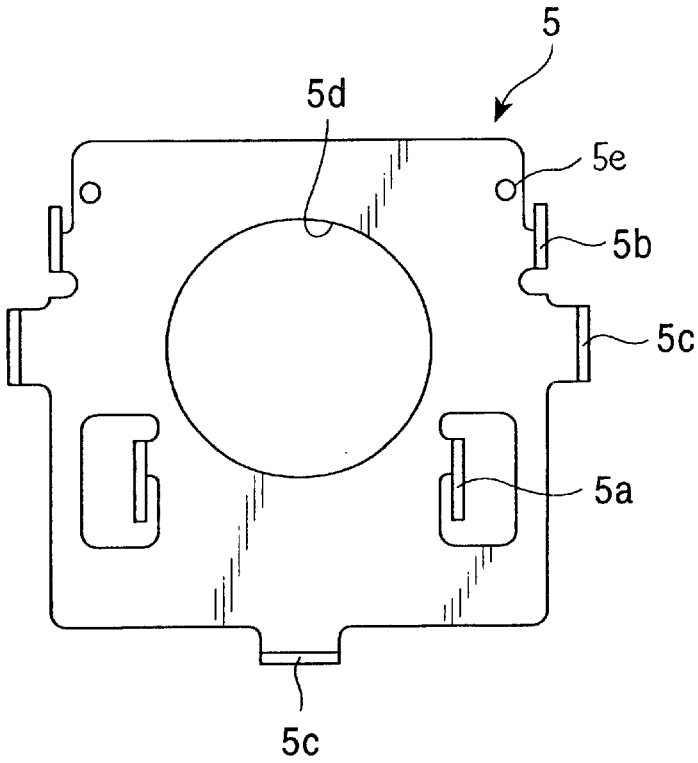
FIG. 10 is a plan view of a plate of the key switch.
Figure 11:
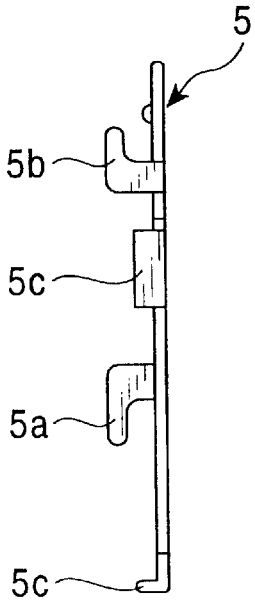
FIG. 11 is a side view of the plate.
Figure 12:
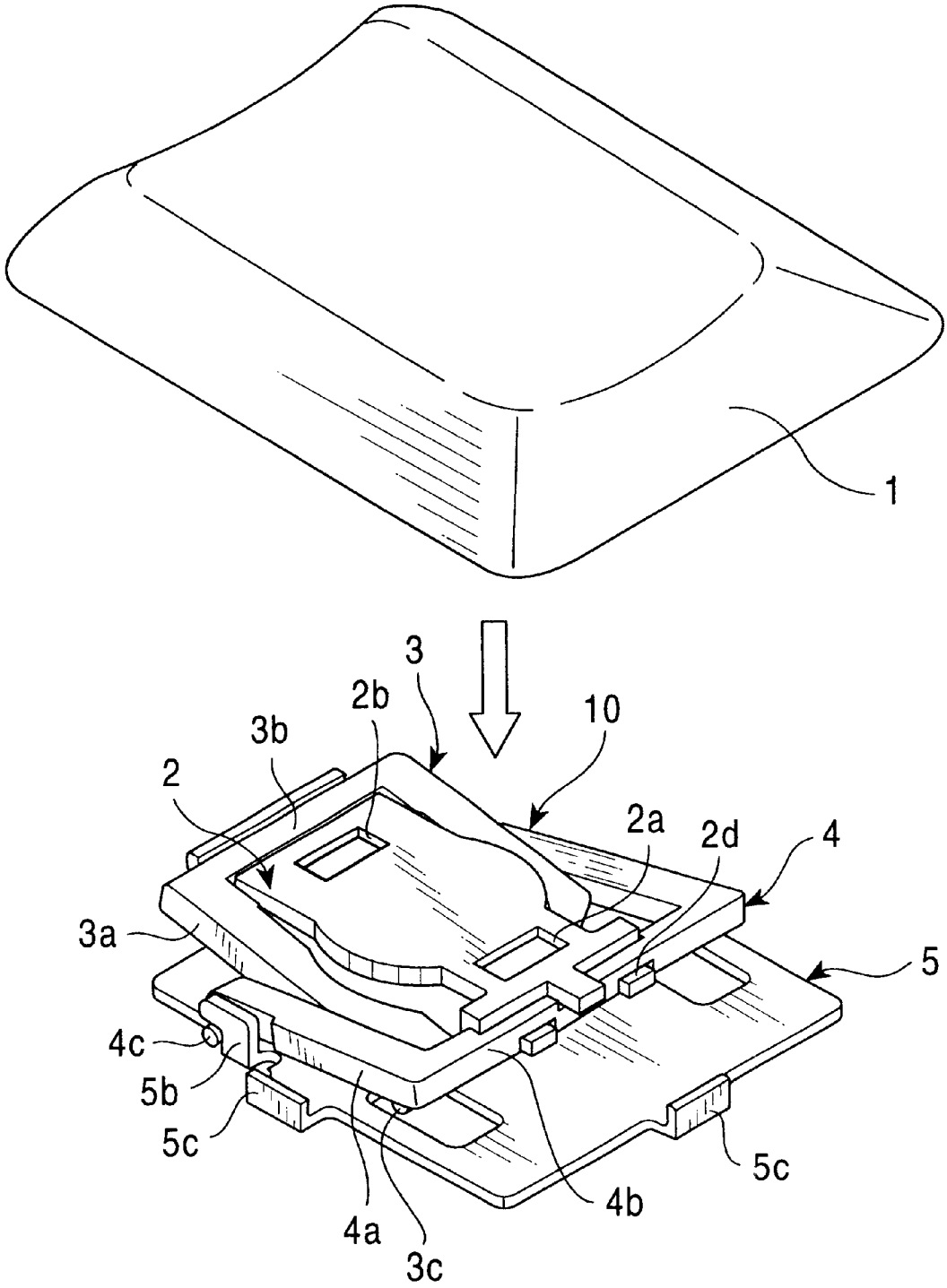
FIG. 12 is a perspective view of a unitary cross-link member of the key switch.
Figure 13:
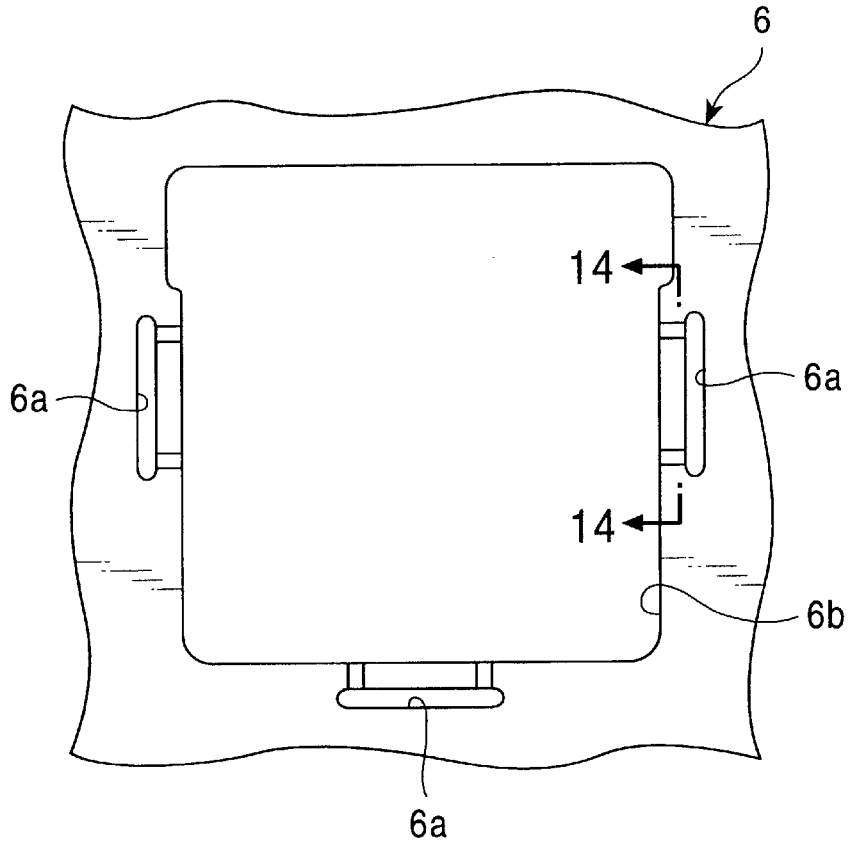
FIG. 13 is a plan view of the main portion of a holding plate of the key switch.
Figure 14:
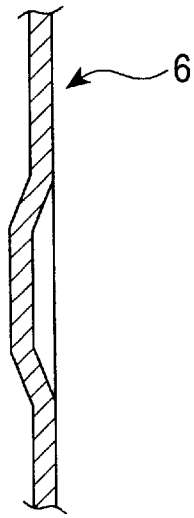
FIG. 14 is a sectional view taken along line 14—14 of FIG. 13.
Figure 15:
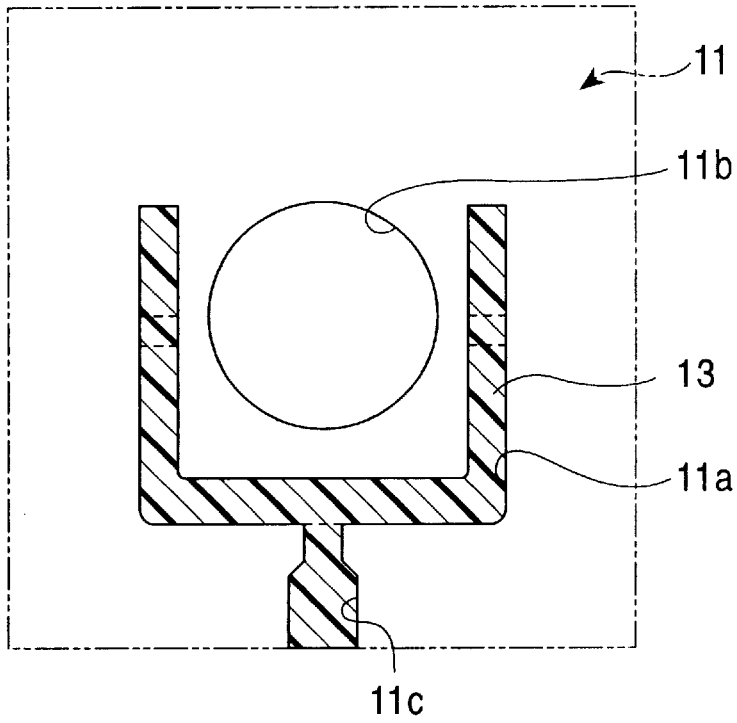
FIG. 15 illustrates a die used for molding the inner lever member of the key switch.
Figure 16:
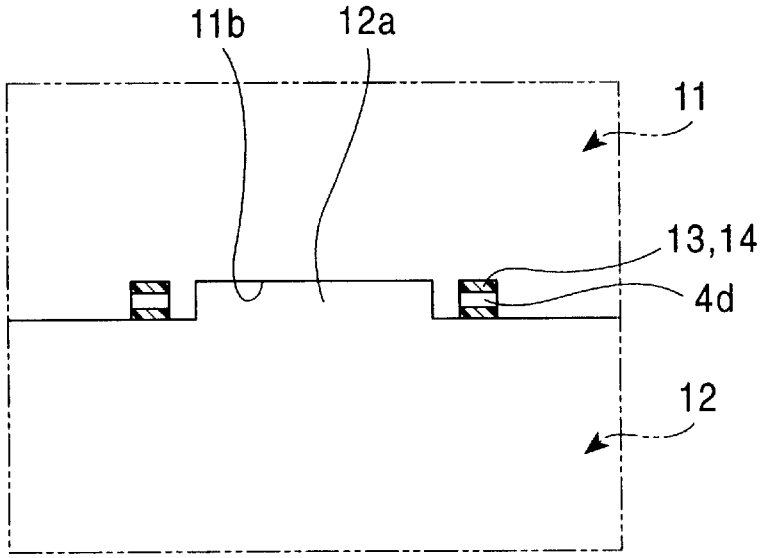
FIG. 16 is a sectional view showing a state prior to the opening of the die in the process of molding the inner lever member.
Figure 17:
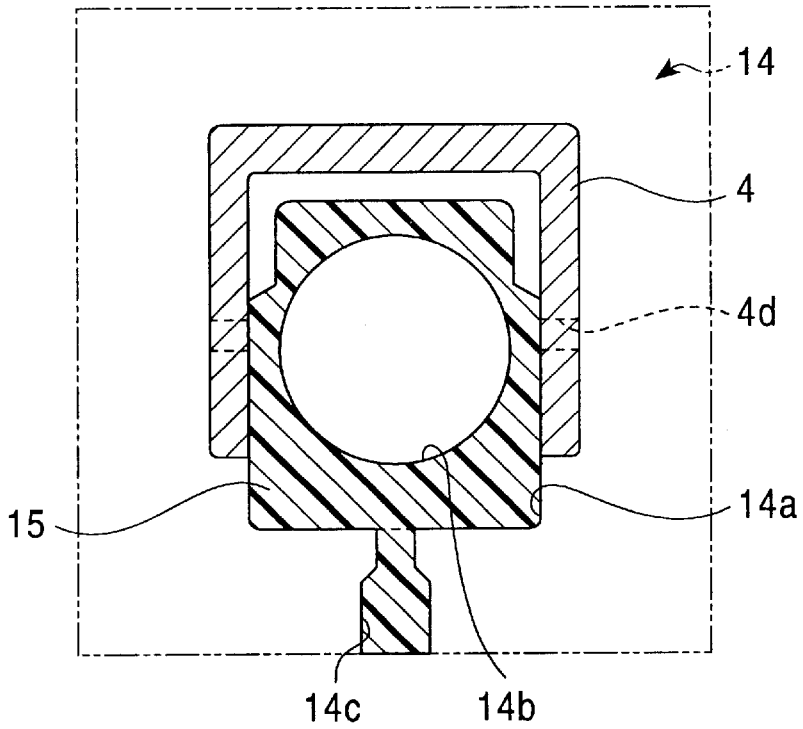
FIG. 17 illustrates a die used for molding the outer lever member of the key switch.
Figure 18:
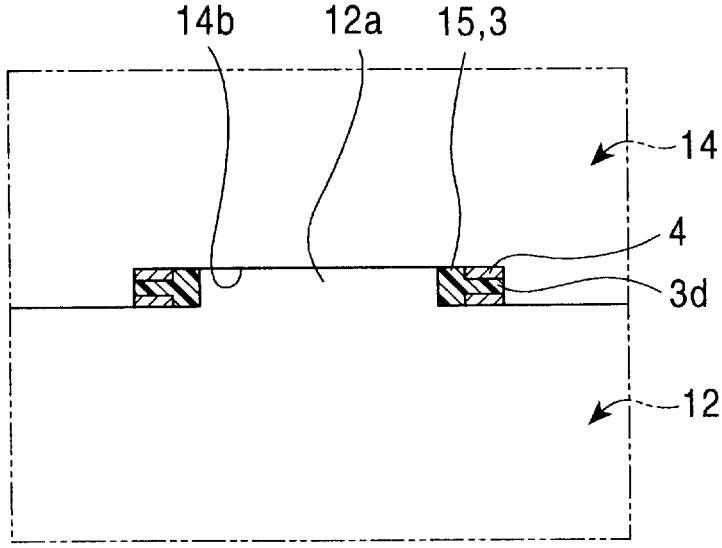
FIG. 18 is a sectional view showing a state prior to the opening of the die in the process of molding the outer lever member.

FIG. 1 is a sectional view of an embodiment of a key switch in accordance with the present invention. FIG. 2 is a plan view of the key switch. FIG. 3 illustrates the bottom surface of a key top of the key switch. FIG. 4 is a plan view of an inner lever member of the key switch. FIG. 5 is a sectional view taken along line 5—5 of FIG. 4. FIG. 6 is a plan view of an outer lever member of the key switch. FIG. 7 is a sectional view taken along line 7—7 of FIG. 6. FIG. 8 is a plan view of an actuator of the key switch. FIG. 9 is a sectional view taken along line C—C of FIG. 8. FIG. 10 is a plan view of a plate of the key switch. FIG. 11 is a side view of the plate. FIG. 12 is a perspective view of a unitary cross-link member of the key switch. FIG. 13 is a plan view of the main portion of a holding plate of the key switch. FIG. 14 is a sectional view taken along line 14—14 of FIG. 13. FIG. 15 illustrates a die used for molding the inner lever member of the key switch. FIG. 16 is a sectional view showing a state prior to the opening of the die in the process of molding the inner lever member. FIG. 17 illustrates a die used for molding the outer lever member of the key switch. FIG. 18 is a sectional view showing a state prior to the opening of the die in the process of molding the outer lever member.

In general, the illustrated key switch comprises a key top 1, an actuator 2, an inner lever member 3 and an outer lever member 4, a plate 5, a holding plate 6, a membrane switch 7, a click rubber 8, and a supporting plate 9. The actuator 2 is stopped at the bottom side of the key top 1. The inner lever member 3 and the outer lever member 4 support the key top 1 through the actuator 2 so that the key top 1 can be raised and lowered. The plate 5 supports the pair of lever members 3 and 4 placed thereon. The holding plate 6 is stopped by the plate 5 placed thereon. The membrane switch 7 performs a switching operation with the raising and lowering of the key top 1. The click rubber 8 is placed on the membrane switch 7 and biases the key top 1 upward through the actuator 2. The supporting plate 9 has the membrane switch 7 placed thereon. This key switch is disposed on a keyboard input device.

The structure of each portion of the key switch will be described in detail below. As shown in FIGS. 1 and 3, a pair of fitting protrusions 1*a* and 1*b* are formed on the bottom side of the key top 1. On the other hand, as shown in FIGS. 8 and 9, a pair of stopper holes 2*a* and 2*b* are formed in the actuator 2. The fitting protrusions 1*a* and 1*b* are forcibly pushed into the corresponding stopper holes 2*a* and 2*b* in order to form the key top 1 and the actuator 2 into an integral structure. The actuator 2 has a shaft groove 2*c* and a protrusion 2*d*. The shaft groove 2*c* is used to rotatably engage the top end of the inner lever member 3 with one end of the actuator 2 in the longitudinal direction thereof. The protrusion 2*d* is used to slidably engage the top end of the outer lever member 4 with the other end of the actuator 2 in the longitudinal direction thereof. A presser portion 2*e* which contacts the top end surface of the click rubber 8 which has the shape of an inverted bowl is formed on the center portion of the bottom surface of the actuator 2.

In the inner lever member 3 shown in FIGS. 4 and 5, a rotary shaft 3*b* is provided at the top ends of a pair of tilting arms 3*a*, a protruding frame-shaped slide pin 3*c* is formed at the bottom ends thereof, and a linking shaft 3*d* is formed at the middle of the outside surfaces of the tilting arms 3*a* so as to protrude sideways. The rotary shaft 3*b* of the inner lever member 3 rotatably engages the shaft groove 2*c* in the actuator 2, whereas the slide pin 3*c* slidably engages first cut-and-raised portions 5*a* of the plate 5 (described later). In the outer lever member 4 shown in FIGS. 6 and 7, a slide shaft 4*b* is provided at the top ends of a pair of tilting arms 4*a*, a protruding U-shaped rotary pin 4*c* is formed at the bottom ends thereof, and a shaft-receiving hole 4*d* which passes through the outer lever member 4 from the inside to the outside thereof is formed in the middle of the tilting arms 4*a*. The slide shaft 4*b* of the outer lever member 4 slidably engages the protrusion 2*d* of the actuator 2, whereas the rotary pin 4*c* rotatably engages second cut-and-raised portions 5*b* of the plate 5 (described later). These lever members 3 and 4 are rotatably linked together at their intersection portions in order to form a cross-link member 10. More specifically, the linking shaft 3*d* of the inner lever member 3 is inserted in a pivotally mounted state in the shaft-receiving hole 4*d* formed in the outer lever member 4. The cross-link member 10 is such as to change height in accordance with the tilting angles of the tilting arms 3*a* of the lever member 3 and tilting arms 4*a* of the lever member 4.

In the embodiment, the lever members 3 and 4 are molded by a two-color molding technology. As shown in FIGS. 15 and 16, in the two-color molding technology, a stationary die 11 (which has a U-shaped cavity 11*a*, a recess 11*b*, and a gate 11*c*) and a movable die 12 (which has a protrusion 12*a* which is fitted to the recess 11*b*) are placed in a clamped state. In the clamped state, a first resin material 13 having a relatively small shrinkage coefficient (such as acrylonitrile-butadiene-styrene (ABS) resin having a shrinkage coefficient of 4/1000) is poured into the cavity 11*a* from the gate 11*c*. The poured resin is cooled and hardened in order to form the outer lever member 4 by molding. Here, a slide core (not shown) is previously inserted in the cavity 11*a* so that, at the stage of hardening the first resin material 13, the shaft-receiving hole 4*d* is formed in the middle of the tilting arms 4*a*. After forming the shaft-receiving hole 4*d*, the movable die 12 which has been separated from the stationary die 11 is rotated 180 degrees and is then moved parallel thereto in order to, as shown in FIGS. 17 and 18, put a stationary die 14 (which has a frame-shaped cavity 14*a*, a recess 14*b*, and a gate 14*c*) and the movable die 12 in a clamped state. The cavity 14*a* and the recess 14*b* are connected. In the clamped state, a second resin material 15 having a relatively large shrinkage coefficient (such as polyacetal resin having a shrinkage coefficient of 20/1000) is poured into the cavity 14*a* from the gate 14*c*. Then, the poured resin is cooled and hardened in order to form the inner lever member 3 by molding. Here, by connecting the shaft-receiving hole 4*d* formed in the outer lever member 4 to the cavity 14*a* formed in the stationary die 14, the shaft-receiving hole 4*d* is filled with the second resin material 15. Therefore, when this second resin material 15 hardens, the linking shaft 3*d* is formed. More specifically, since the shrinkage coefficient of the second resin material 15 is greater than that of the first resin material 13, when the second resin material 15 in the shaft-receiving hole 4*d* is cooled and hardened to mold the linking shaft 3*d*, a clearance is produced between the shaft-receiving hole 4*d* and the linking shaft 3*d*, so that the linking shaft 3*d* is molded in a pivotally mounted state in the shaft-receiving hole 4*d*.

As shown in FIGS. 10 and 11, the plate 5 formed by pressing a metallic plate has a pair of the first cut-and-raised portions 5*a*, a pair of the second cut-and-raised portions 5*b*, three third cut-and-raised portions 5*c*, and a clearance hole 5*d*. The pair of first cut-and-raised portions 5*a* are provided to slidably engage the slide pin 3*c* therewith. The pair of second cut-and-raised portions 5*b* are provided to rotatably engage the rotary pin 4*c* therewith. Protuberances Se act to secure the rotary pin 4*c* within the second cut-and-raised portions 5*b*. The three third cut-and-raised portions 5*c* protrude from three locations of the plate 5 and are inserted into stopper holes 6*a* formed in the holding plate 6 (described later). The clearance hole 5*d* is formed to insert the click rubber 8 (described later) therein. In other words, while the bottom end of the inner lever member 3 slidably engages the plate 5, and the bottom end of the outer lever member 4 rotatably engages the plate 5, the cross-link member 10 is installed. Accordingly, this means that the cross-link member 10 is mounted on the plate 5 while the tilting arms 3*a* and 4*a* which change the crossing angle of the lever members 3 and 4 are allowed to tilt. Therefore, the cross-link member 10 obtained has a unitary structure. As discussed above, the top end of the inner lever member 3 rotatably engages the actuator 2, whereas the top end of the outer lever member 4 slidably engages the actuator 2, so that, ultimately, the actuator 2, the cross-link member 10, and the plate 5 are formed into a unitary structure (see FIG. 12).

As shown in FIG. 13, the stopper holes 6*a* and a clearance hole 6*b* are formed in the holding plate 6 formed by pressing a metallic plate. The stopper holes 6*a* are formed for inserting therein the third cut-and-raised portions 5*c* of the plate 5. The clearance hole 6*b* is formed for inserting the click rubber 8 (described later) therein.

The membrane switch 7 serving as a switch element is a conventionally known switch having a spacer interposed between an upper sheet and a lower sheet. It is sandwiched between the holding plate 6 and the supporting plate 9. A switch section of the membrane switch 7 is positioned below the clearance hole 5*d* in the plate 5 and the clearance hole 6*b* in the holding plate 6. In the switch section, an upper electrode and a lower electrode opposing each other are formed through an opening in the spacer.

The inverted bowl-shaped click rubber 8 is disposed on the membrane switch 7 while the top end surface of the click rubber 8 contacts the presser portion 2*e* of the actuator 2. A presser protrusion 8*a* protrudes downward at the inner side of the click rubber 8. The upper electrode of the membrane switch 7 is positioned below the presser protrusion 8*a*.

A description of the operation of the key switch having the above-described structure will now be given. When the operator presses the key top 1 of the key switch in a switched off state shown in FIG. 1, the tilting arms 3*a* and 4*a* of the corresponding lever members 3 and 4 are lowered as the actuator 2 is lowered, causing the cross-link member 10 to be lowered. When the key top 1 is lowered by a predetermined amount, the click rubber 8 which has been pushed by the presser portion 2*e* of the actuator 2 is buckled, causing the presser protrusion 8*a* to push and flex the upper sheet of the membrane switch 7. As a result, the upper electrode of the switch section comes into contact with the lower electrode, whereby the switch section is switched on. On the other hand, when the pressing force on the key top 1 in the switched-on state is removed, the buckled click rubber 8 returns to its original shape due to its own resiliency, so that the upper electrode of the membrane switch 7 separates from the lower electrode, causing the key switch to be restored to its original switched-off state. In addition, since the actuator 2 is raised, the cross-link member 10 is raised, causing the key top 1 to be pushed upward to its initial position.

In the embodiment, as described above, the outer lever member 4 and the inner lever member 3 are successively molded in order to form the cross-link member 10 in which the linking shaft 3*d* engages in a pivotally mounted state the shaft-receiving hole 4*d*. Therefore, it is no longer necessary to carry out the troublesome assembly operation of linking the pair of lever members 3 and 4 manually, so that the assembly operation is carried out with considerably greater ease. Even in the case where the lever members 3 and 4 are extremely small, these lever members 3 and 4 can be easily and reliably linked together to form the cross-link member 10, thereby making it easier to accelerate size reduction of the key switch.

In the embodiment, the pair of lever members 3 and 4 are mounted on the plate 5 having the cut-and-raised portions 5*a* and 5*b* in order to form the cross-member 10 having a unitary structure. Therefore, prior to installing it on the membrane switch 7, any malfunctioning of the cross-link member 10 can be confirmed.

In the embodiment, at the stage of assembly, the fitting protrusions 1*a* and 1*b* of the key top 1 are forcibly pushed into the actuator 2 which engages and supports the top ends of the pair of lever members 3 and 4. Therefore, after placing and mounting the.unitary cross-link member 10 onto the holding plate 6 on the membrane switch 7, the key top 1 can be very easily mounted.

Figure 19:
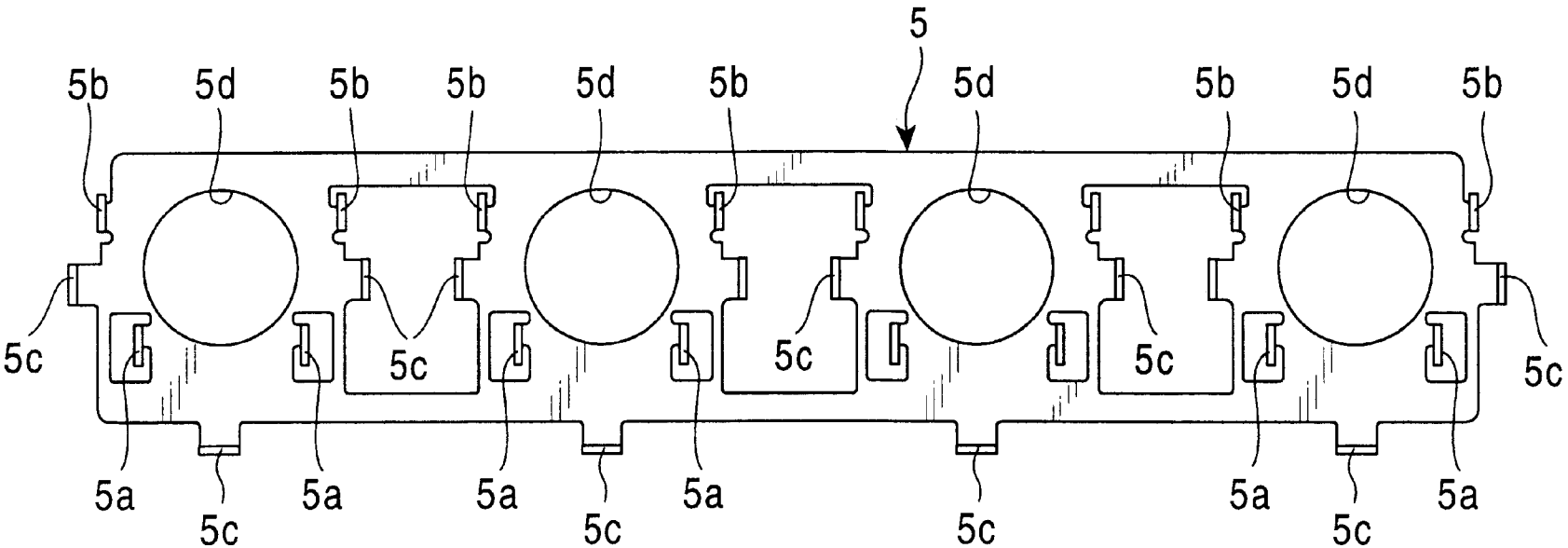
FIG. 19 is a plan view of a plate used in another embodiment of the present invention.

As shown in FIG. 19, a plate 5 which is long sideways and which allows a plurality of pairs of lever members 3 and 4 to be placed thereon for supporting them may also be used in order to allow a plurality of key switches to share one plate 5. When the plate 5 having such a form is used, a plurality of cross-link members 10 (four in FIG. 19) can be arranged in a row on the one plate 5 in order to form them into a unitary structure. Therefore, the assembly operation of the key switch of the keyboard input device can be carried out efficiently.

The present invention is carried out in the forms such as those described above, and provides the following advantages.

After molding the lever member which is formed of a resin material having a small shrinkage coefficient and which has a shaft-receiving hole, a resin material having a large shrinkage coefficient is hardened in a die in which the shaft-receiving hole forms a portion of the cavity in order to mold the other lever member. Therefore, the pair of lever members are linked together in order to form the cross-link member without carrying out a manual operation, so that size reduction of the key switch can be accelerated and the assembly operation can be carried out with greater ease.

What is claimed is:

1. A key switch comprising:

a pair of lever members which are rotatably linked together at crossing portions thereof by pivotally mounting a linking shaft in a shaft-receiving hole;

a key top which supports the pair of lever members so as to raise and lower the lever members;

a resilient member for biasing the key top upwards; and a switch element for performing a switching operation with the raising and lowering of the key top;

wherein the pair of lever members are formed from first and second resin materials having different shrinkage coefficients;

wherein the shaft-receiving hole is formed in the lever member formed of the first resin material; and wherein the linking shaft entering in the shaft-receiving hole is formed at the lever member formed of the second resin material having a larger shrinkage coefficient than that of the first resin material.

2. A method of producing a key switch including a pair of lever members which are rotatably linked together at crossing portions thereof by pivotally mounting a linking shaft in a shaft-receiving hole, a key top which supports the pair of lever members so as to raise and lower the lever members, a resilient member for biasing the key top upwards, and a switch element for performing a switching operation with the raising and lowering of the key top, the method comprising the step of:

molding the lever member having the shaft-receiving hole as a result of hardening a first resin material in a die; and molding the other lever member having the linking shaft as a result of hardening a second resin material having a larger shrinkage coefficient than the first resin material in a die in which the shaft-receiving hole forms a portion of a cavity in order to form the other lever member, whereby the linking shaft is formed in a pivotally mounted state in the shaft-receiving hole and whereby the two lever members are rotatably linked together.

3. A key switch as recited in claim 1, further comprising:

an actuator for rotatably engaging the upper end of one of the lever members therewith and rotatably or slidably engaging the upper end of the other lever member therewith, the actuator retaining the key top, whereby the key top supports the pair of lever members through the actuator.

4. A key switch as recited in claim 1, further comprising:

a plate having a first louver portion for slidably engaging the lower end of one of the lever members therewith and a second louver portion for rotatably or slidably engaging the lower end of the other lever member therewith; and a holding plate, the plate being mounted to the holding plate.

5. A key switch as recited in claim 1, wherein the first resin material is acrylonitrile-butadiene-styrene resin material, and the second resin material is polyacetal resin.

6. A method of producing a key switch according to claim 2, wherein the first resin material is acrylonitrile-butadiene-styrene resin material, and the second resin material is polyacetal resin.

7. A method of producing a key switch according to claim 2, further comprising:

rotatably engaging the upper end of one of the lever members to an actuator; and rotatably or slidably engaging the upper end of the other lever member to the actuator, the actuator retaining the key top, whereby the key top supports the pair of lever members through the actuator.

8. A method of producing a key switch according to claim 2, further comprising:

slidably engaging the lower end of one of the lever members within a first louver portion of a plate; and rotatably or slidably engaging the lower end of the other lever member with a second louver portion of the plate.

* * * * *